US006511447B1

(12) United States Patent
Huang

(10) Patent No.: US 6,511,447 B1
(45) Date of Patent: Jan. 28, 2003

(54) SWING MACHINE

(76) Inventor: Yu-Tong Huang, No. 77, Yong-An Road, Tainan City (TW)

( * ) Notice: Subject to any disclaimer, the term of this patent is extended or adjusted under 35 U.S.C. 154(b) by 0 days.

(21) Appl. No.: 10/100,041

(22) Filed: Mar. 19, 2002

(51) Int. Cl.[7] ..... A61H 1/00

(52) U.S. Cl. ..... 601/28; 601/30; 601/31; 601/51; 482/79

(58) Field of Search ..... 482/79, 80, 148; 472/119; 601/23, 27, 28, 29, 31, 32, 30, 34, 35, 104, 98, 49, 51, 53, 54

(56) References Cited

U.S. PATENT DOCUMENTS 5,088,473 A * 2/1992 Chen et al. ..... 601/26
5,107,822 A * 4/1992 Ohashi ..... 482/79
5,372,563 A * 12/1994 Chien-Nan ..... 482/79
5,417,644 A * 5/1995 Lee ..... 601/101
5,419,753 A * 5/1995 Wang ..... 601/31
5,643,181 A * 7/1997 Lin ..... 601/112
6,013,040 A * 1/2000 Morgenstern et al. ... 297/284.1

* cited by examiner

*Primary Examiner*—Kien T. Nguyen
(74) *Attorney, Agent, or Firm*—Rosenberg, Klein & Lee

(57) ABSTRACT

A swing machine includes a casing having a sliding member movably engaged with a rail and the sliding member is driven by a block eccentrically connected to an output shaft of a motor. A support member is connected to a top of the sliding member. A first protrusion extends from a side of the sliding member and a limitation member located in the casing has a wave-shaped slot in which the second protrusion is movably engaged.

3 Claims, 7 Drawing Sheets

SWING MACHINE

FIELD OF THE INVENTION

The present invention relates to a swing machine having a wave-shaped slot such that the support member moves in various directions.

BACKGROUND OF THE INVENTION

A conventional swing machine is shown in FIG. 7 and includes a motor 71 whose output shaft 711 is eccentrically connected to a block 72. A sliding member 73 is movably engaged with two rods 74 and the block 72 has a protrusion 722 which is engaged with the sliding member 73. A support member 75 is connected to the sliding member 73 so that when the motor 71 is in operation, the block 72 drives the sliding member 73 to move in a horizontal direction. A use may put his/her feet on the support member 75 and the muscles of the feet can be relaxed by the swing of the support member 75. However, the way of swing does not change and is boring for the users so that the market expects new generation of the swing machine that may generate various ways of swing to effectively relax the muscles of the feet of users.

SUMMARY OF THE INVENTION

In accordance with one aspect of the present invention, there is provided a swing machine which comprises a casing having a motor received therein. A block is eccentrically connected to an output shaft of the motor and a first protrusion extends from a side of the block. A rail is located in the casing and has a groove. A sliding member is slidably engaged with the groove and has a slot in which the first protrusion of the block is movably engaged. A second protrusion extends from a side of the sliding member and a top of the sliding member is connected to a support member. A limitation member is located in the casing and has a wave-shaped slot in which the second protrusion is movably engaged.

The primary object of the present invention is to provide a swing machine wherein the support member is moved in various ways and directions.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
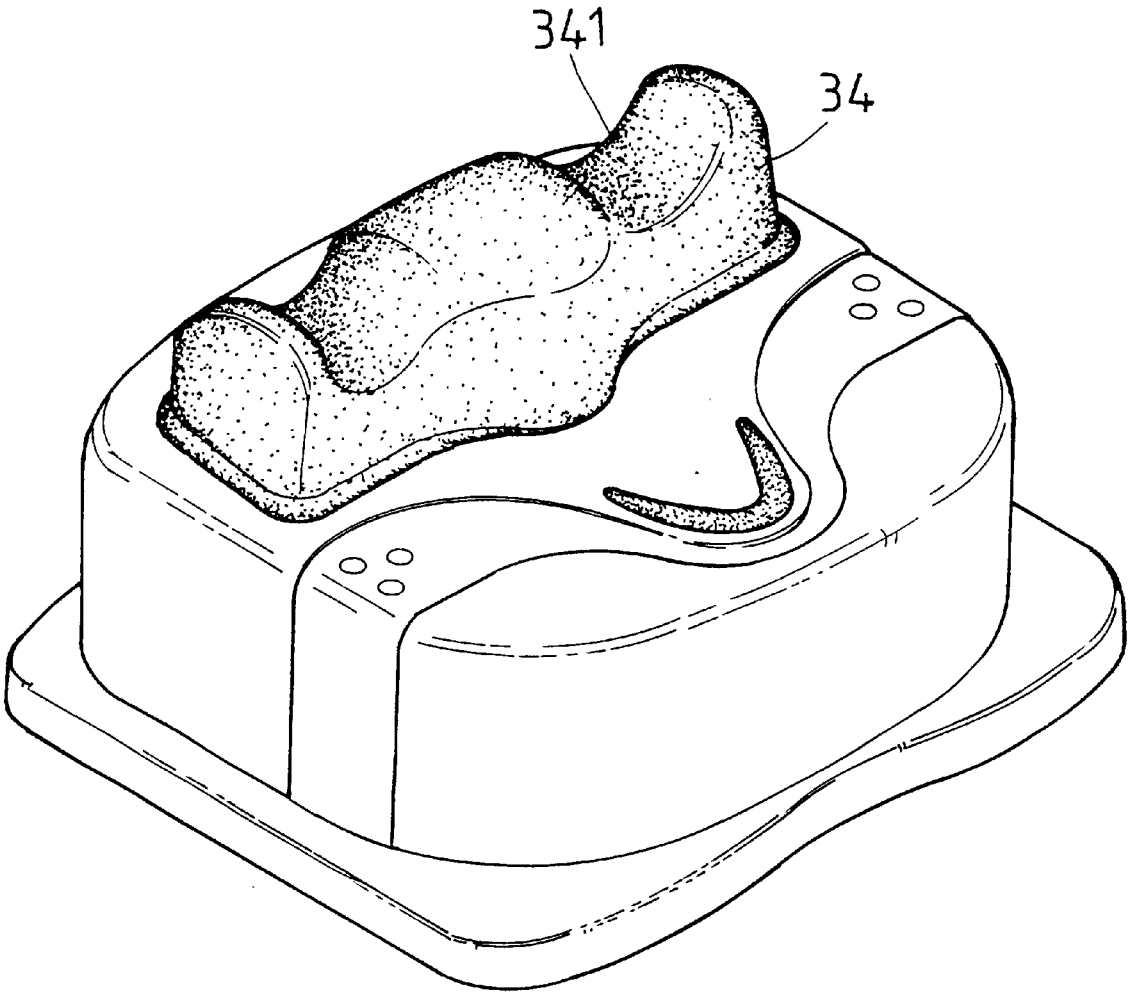
FIG. 1 is a perspective view to show the swing machine of the present invention.
Figure 2:
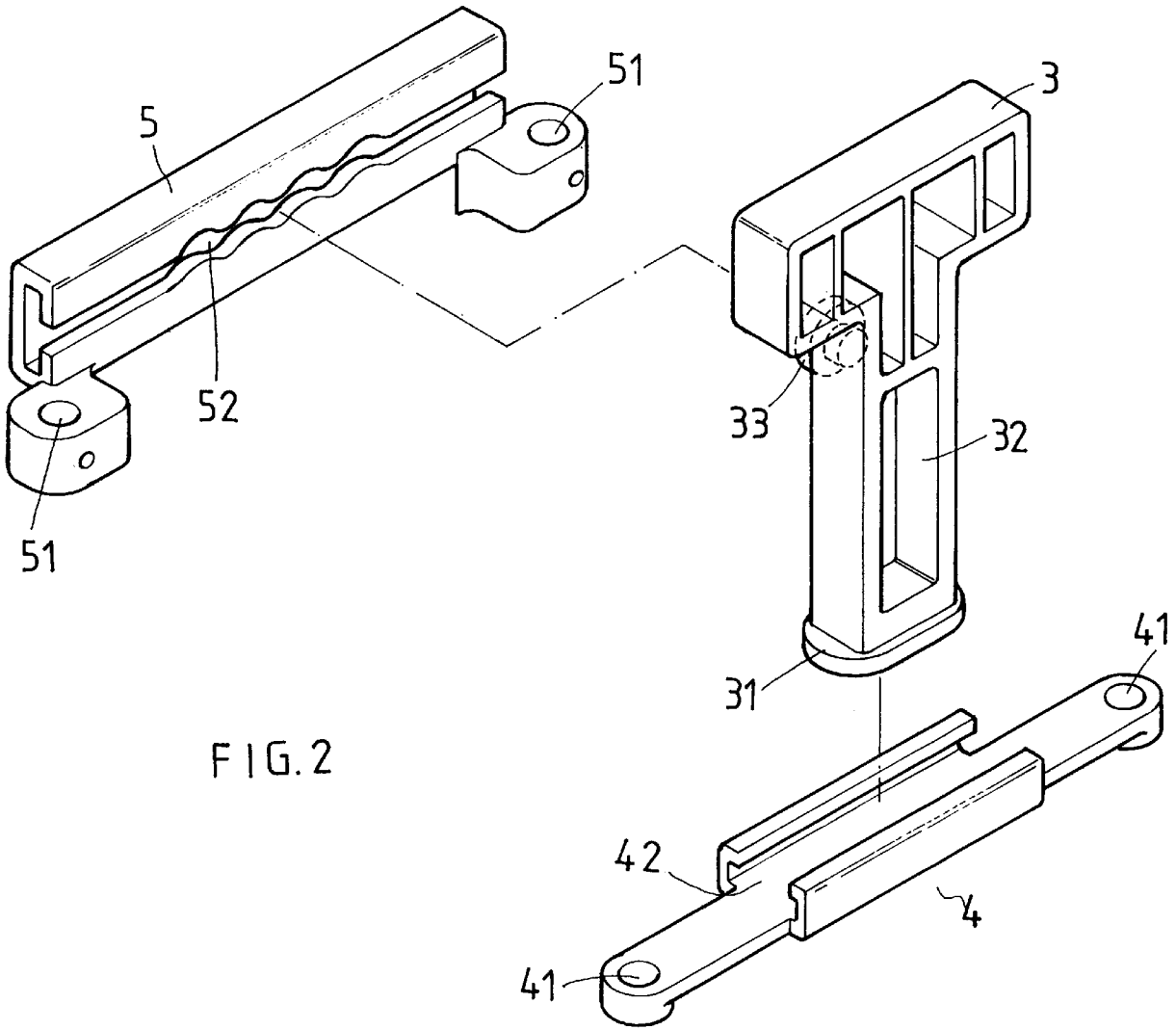
FIG. 2 is an exploded view to show the rail, the sliding member and the limitation member of the swing machine of the present invention.
Figure 3:
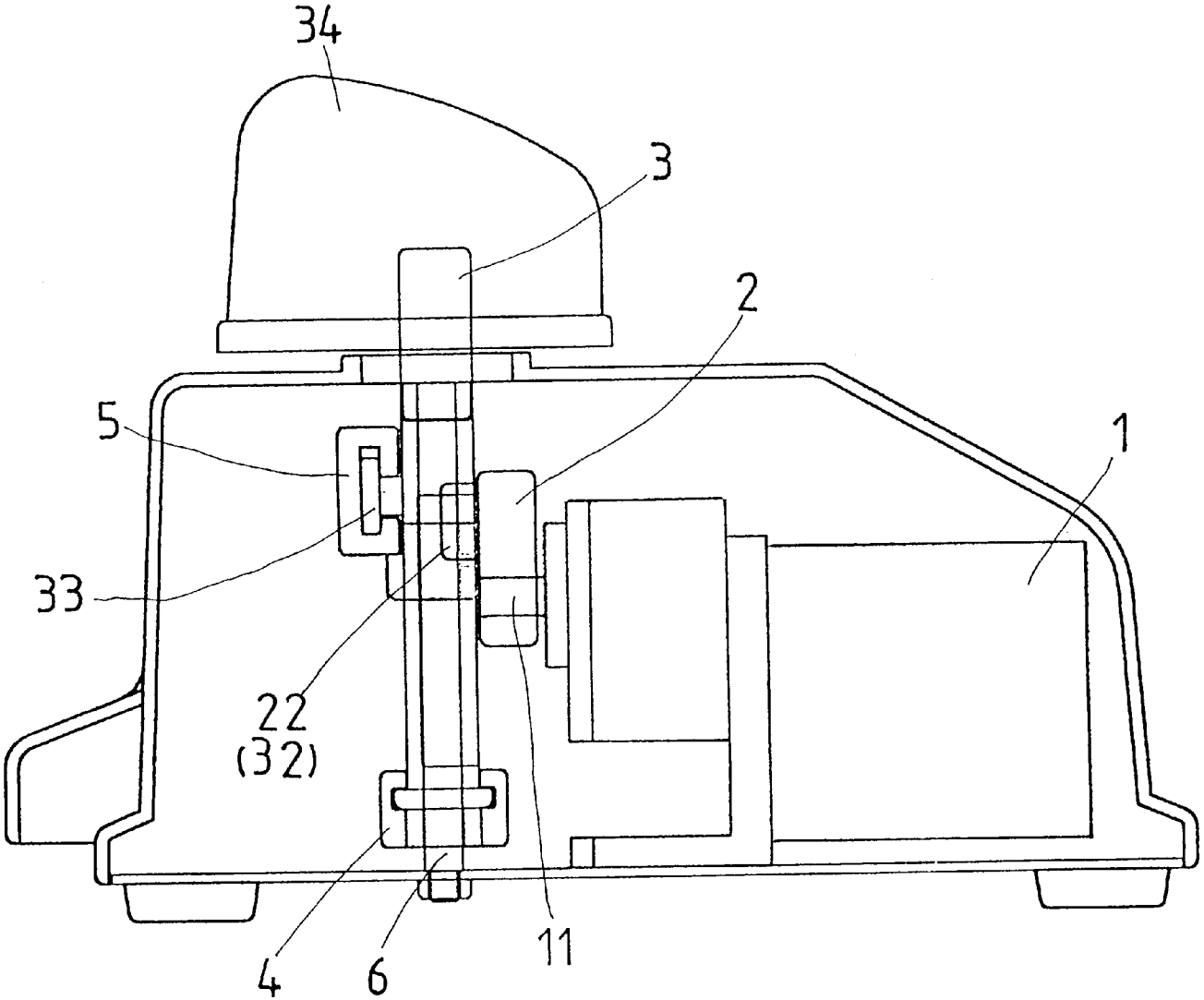
FIG. 3 is a side view to show the swing machine of the present invention.

Referring to FIGS. 1 to 4, the swing machine of the present invention comprises a casing and a motor 1 is received in the casing. A block 2 is eccentrically connected to an output shaft 11 of the motor 1 and a first protrusion 22 extends from a side of the block 2.

Two posts 6 are located in the casing and a rail 4 is mounted between the two posts 6 by mounting two rings 41 on two ends of the rail 4 to the two posts 6. A groove 42 is defined in the rail 4. A sliding member 3 has a flange 31 extending from a lower end of the sliding member 3 and the flange 31 is slidably engaged with the groove 42 in the rail 4. A support member 34 is connected to a top of the sliding member 3 and includes two recesses 341 so that two feet of the users can be put in the two recesses 341. A slot 32 is defined in a side of the sliding member 3 so that the first protrusion 22 of the block 2 is movably engaged. A second protrusion 33 extends from the other side of the sliding member 3.

A limitation member 5 has two rings 51 mounted to the two posts 6 and has a slot which includes a section of wave-shaped slot 52. The second protrusion 33 is movably engaged in the slot in the limitation 5.

Figure 4:
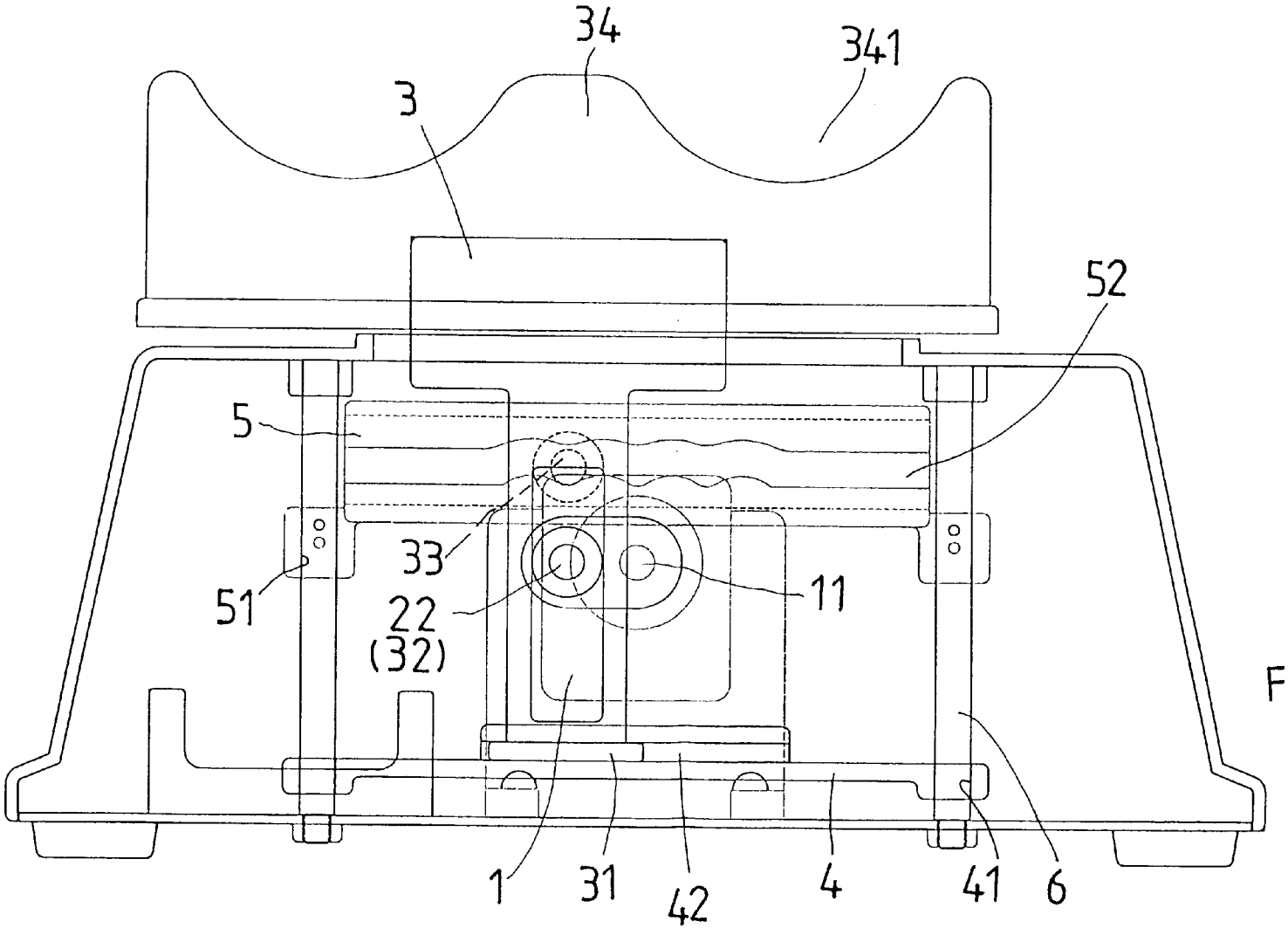
FIGS. 4 to 6 show the three positions of the second protrusion in the wave-shaped slot.
Figure 5:
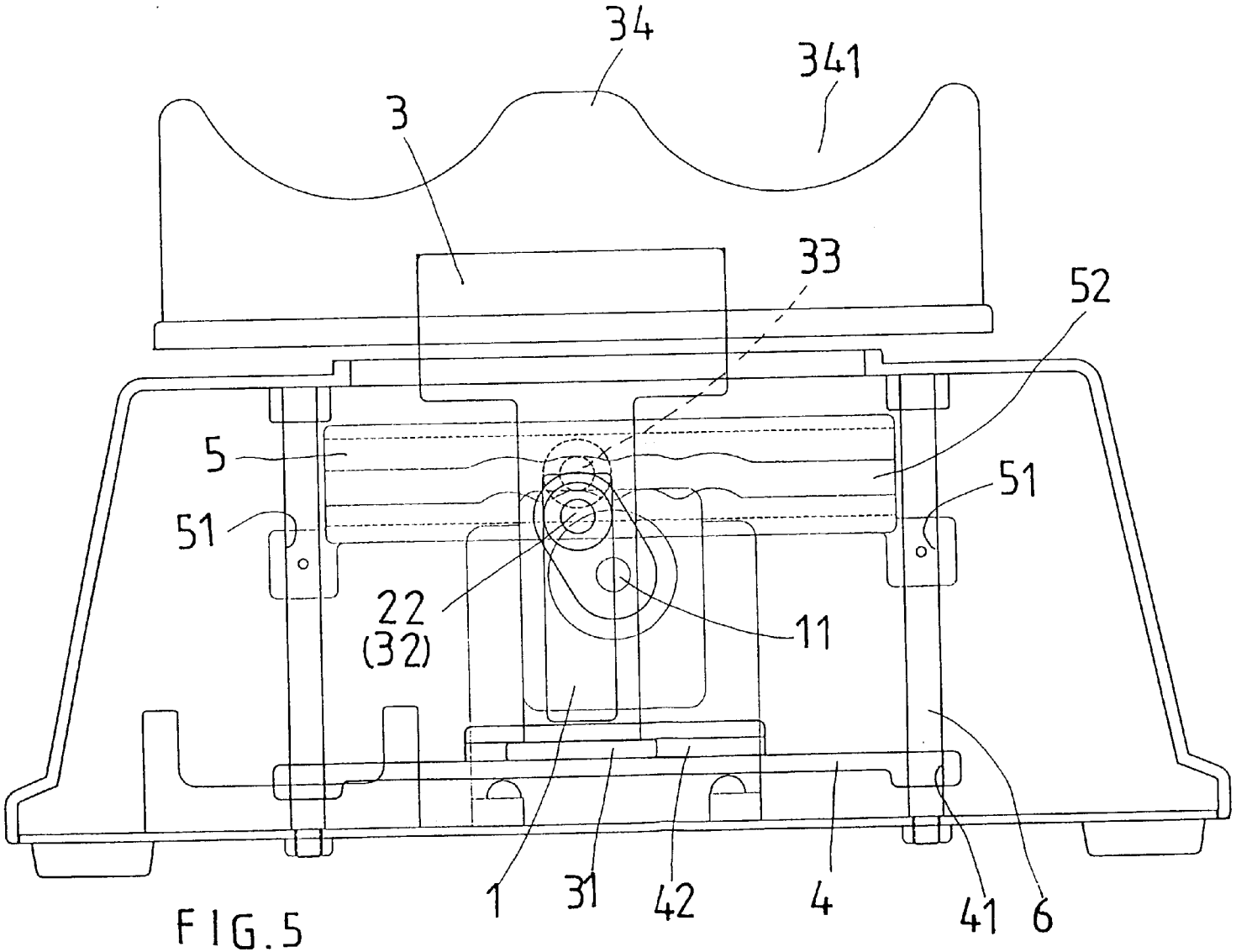
Figure 6:
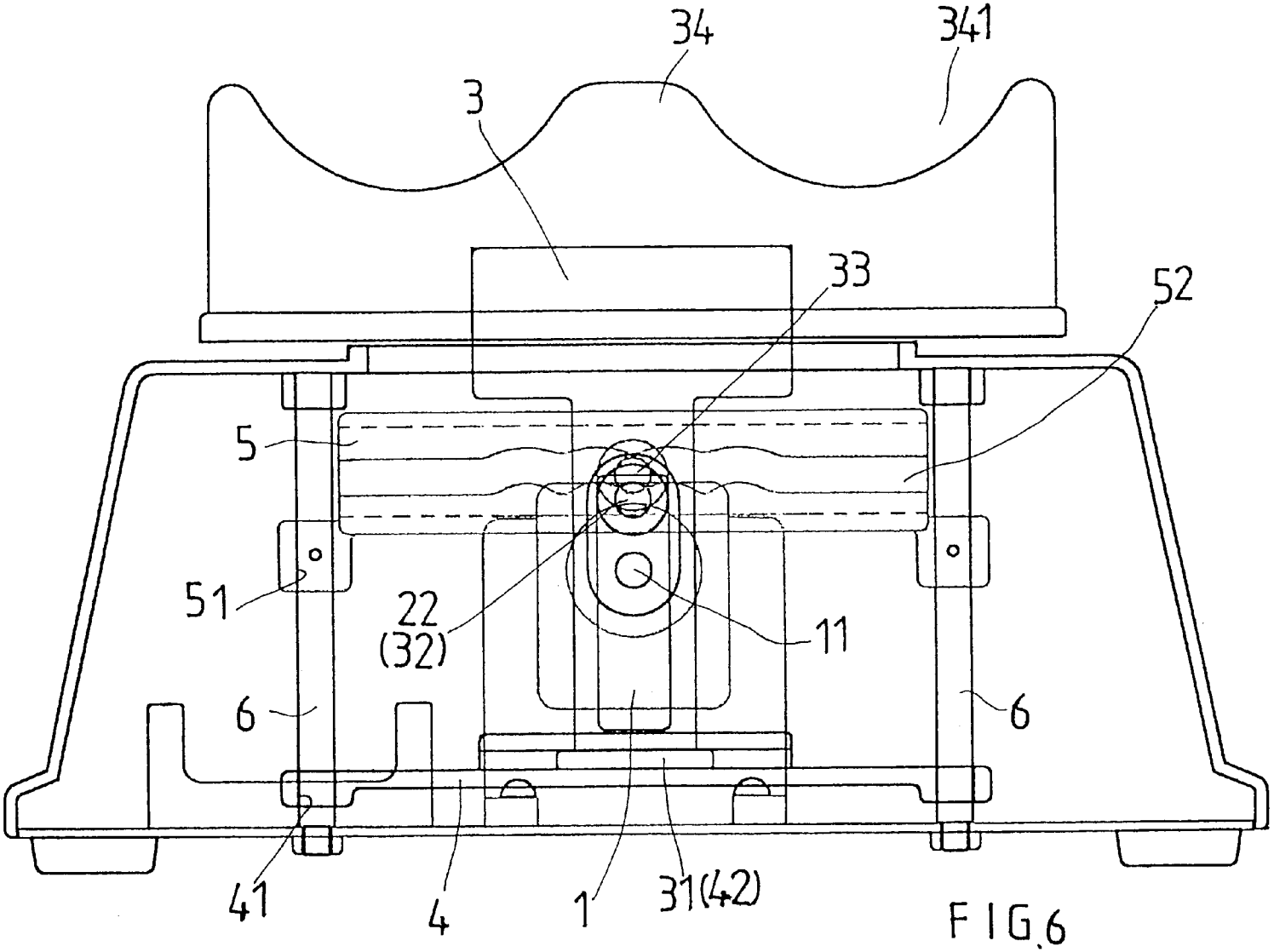
Figure 7:
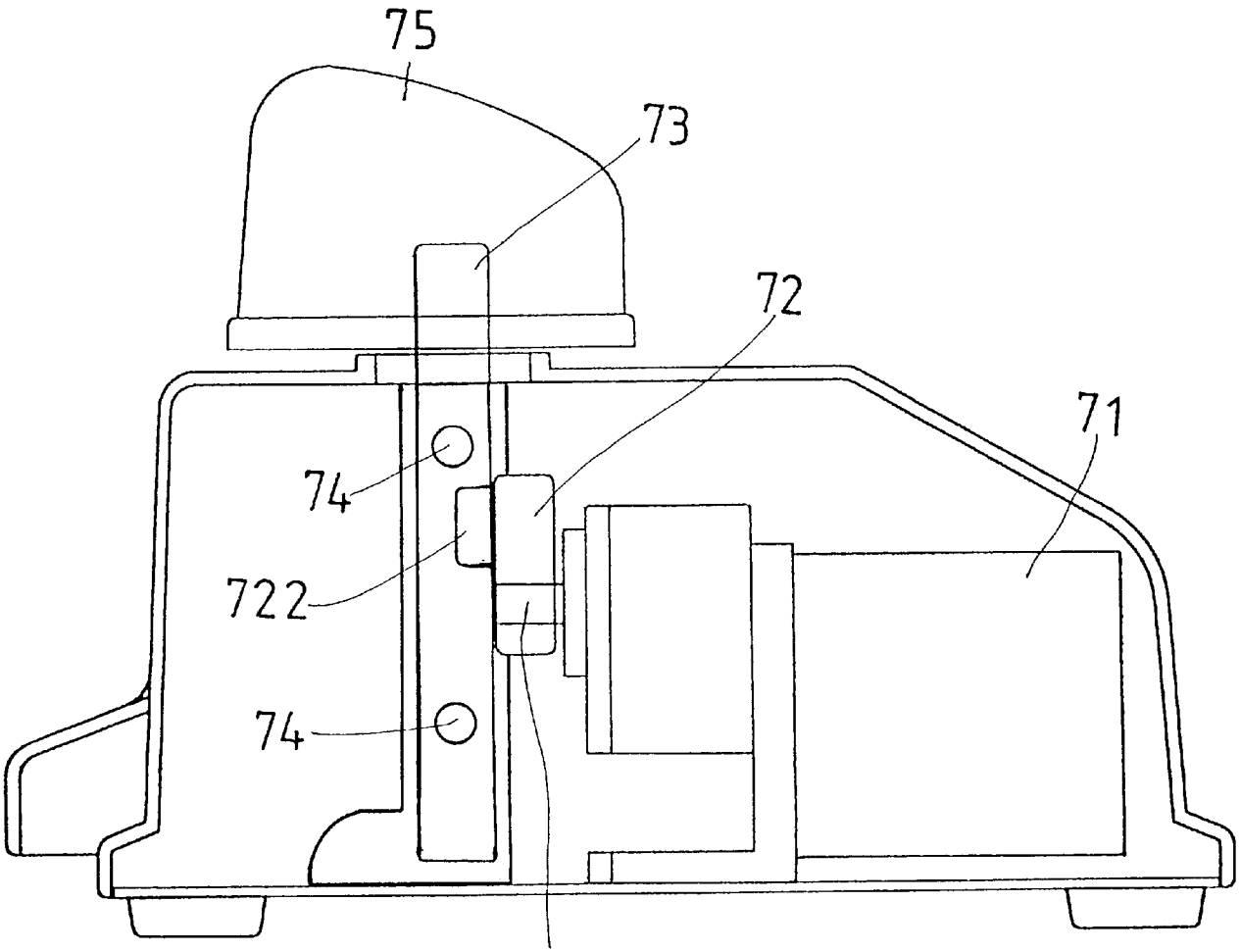
FIG. 7 PRIOR ART
FIG. 7 shows a side view of a conventional swing machine.

As shown in FIGS. 4 to 6, when the motor 1 is rotated, the block 2 drives the sliding member 3 moves in a horizontal direction as performed by the conventional swing machine. When the second protrusion 33 enters in the wave-shaped slot 52, the sliding member 3 generates an up-and-sown movement and when the second protrusion 33 leaves from the wave-shaped slot 52 the support member 34 moves in horizontal direction. By the limitation member 5, the support member 34 may move in different ways and directions.

While we have shown and described the embodiment in accordance with the present invention, it should be clear to those skilled in the art that further embodiments may be made without departing from the scope of the present invention.

What is claimed is:

1. A swing machine comprising:

a casing having a motor with a block eccentrically connected to an output shaft of the motor, a first protrusion extending from a side of the block;

a rail located in the casing and having a groove defined therein, a sliding member slidably engaged with the groove and having a slot in which the first protrusion of the block is movably engaged, a second protrusion extending from a side of the sliding member and a top of the sliding member connected to a support member, and a limitation member located in the casing and having a wave-shaped slot in which the second protrusion is movably engaged.

2. The swing machine as claimed in claim 1 further comprising two posts located in the casing and the rail and the limitation member each having two rings on two ends thereof so as to be mounted to the two posts.

3. The swing machine as claimed in claim 1 further comprising a flange extending from a lower end of the sliding member and the flange slidably engaged with the groove in the rail.

* * * * *